US006553701B1

(12) United States Patent
Neisen et al.

(10) Patent No.: US 6,553,701 B1
(45) Date of Patent: Apr. 29, 2003

(54) IDENTIFICATION HOLDER

(76) Inventors: Angela J. Neisen, 24175 E. Cedar Lake Dr., New Prague, MN (US) 56071; Christopher A. Neisen, 24175 E. Cedar Lake Dr., New Prague, MN (US) 56071

( * ) Notice: Subject to any disclaimer, the term of this patent is extended or adjusted under 35 U.S.C. 154(b) by 0 days.

(21) Appl. No.: 09/610,448

(22) Filed: Jul. 5, 2000

Related U.S. Application Data

(63) Continuation of application No. 09/022,086, filed on Feb. 11, 1998, now abandoned, which is a continuation-in-part of application No. 08/757,482, filed on Nov. 27, 1996, now abandoned.

(51) Int. Cl.[7] ..... G09F 23/00; G09F 7/02

(52) U.S. Cl. ..... 40/645; 40/611

(58) Field of Search ..... 40/299.01, 606, 40/611, 643, 645, 642.02, 661.05, 707, 775, 777, 791; 248/156, 530, 544

(56) References Cited

U.S. PATENT DOCUMENTS

| | | | |
|---|---|---|---|
| 1,777,859 | A | 10/1930 | Recker |
| 1,896,695 | A | 2/1933 | Borovicka |
| 2,007,077 | A | 7/1935 | Cox |
| 2,012,990 | A | 9/1935 | Choate |
| 2,048,906 | A | 7/1936 | Webster |
| 2,052,030 | A | 8/1936 | Holzer |
| 2,183,437 | A | 12/1939 | Walter |
| 2,207,180 | A | 7/1940 | Smith et al. |
| 2,461,054 | A | 2/1949 | Green |
| 2,595,530 | A | 5/1952 | Kuefner |
| 2,639,524 | A | 5/1953 | Irving |
| 2,790,257 | A | 4/1957 | Ware |
| 2,807,897 | A | 10/1957 | Reynolds |
| 2,835,994 | A | 5/1958 | Kuefner |
| 2,857,695 | A | 10/1958 | Goetting |
| D186,779 | S | 12/1959 | Borin |
| 3,057,093 | A | 10/1962 | Gallo |
| 4,044,485 | A | 8/1977 | Hopp |
| 4,052,773 | A | 10/1977 | Nesbitt |
| 4,079,530 | A | 3/1978 | Atherton et al. |
| 4,128,955 | A | 12/1978 | Marra et al. |
| 4,146,985 | A | 4/1979 | Margulies |
| 4,196,553 | A | 4/1980 | Kamphausen |
| 4,268,984 | A | 5/1981 | Taylor |
| 4,291,475 | A | 9/1981 | Schoemer |
| 4,304,059 | A | 12/1981 | Tisbo et al. |
| 4,534,125 | A | 8/1985 | Buck |
| 4,660,309 | A | 4/1987 | LaRocca |
| 4,765,077 | A | 8/1988 | Rosenthal et al. |
| 4,862,823 | A | 9/1989 | Hughes |
| 5,369,902 | A | 12/1994 | Minster |

FOREIGN PATENT DOCUMENTS

| | | | |
|---|---|---|---|
| AT | 214116 | 3/1961 | ..... 40/606 |

*Primary Examiner*—Brian K. Green
(74) *Attorney, Agent, or Firm*—Crompton, Seager & Tufte, LLC

(57) ABSTRACT

An improved identification holder suitable for use in environments conducive to sign deterioration, and having changing subject applications and particular viewing requirements, and that permits easy insertion, and intentional removal and replacement of a flexible information sheet, while substantially preventing intentional or accidental removal or displacement of the information sheet by either small children and the like or elements such as sleet, hail, wind, rain, and other such elements. An information sheet can be removably seated into an undercut portion within an interior display chamber and cannot be easily removed without applying pressure against the inner wall of the information sheet via a sheet removal tool inserted through a selected orifice located at the back side of the display chamber, or alternatively by accessing a selected edge of the information sheet via a sheet removal tool inserted into the undercut portion via one or more selected passages configured to allow the sheet removal tool to penetrate the undercut portion of the identification holder.

7 Claims, 11 Drawing Sheets

IDENTIFICATION HOLDER

This Application is a Continuation of CPA application filed Oct. 22, 1999, which is Continuing Prosecution Application of Ser. No. 09/022,086, filed Feb. 11, 1998, now abandoned, which is a Continuation-in-Part of U.S. patent application Ser. No. 08/757,482, filed Nov. 27, 1996 and now abandoned, by the present inventors, and entitled Identification Holder.

BACKGROUND OF THE INVENTION

1. Field of the Invention

This present invention relates generally to identification holders, and more particularly to useful improvements and structural refinements in identification holders such as are commonly employed for identification of flowers, vegetables, shrubs and other varieties of plants.

2. Description of the Prior Art

Various identification holders have been suggested at one time or another, but in each instance, these devices leave something to be desired. For example, there is a need for an interchangeable sign system for use in environments conducive to sign deterioration, and having changing subject applications and particular viewing requirements, and that permits easy removal and replacement of the information sheet portion of the identification holder, while substantially preventing intentional or accidental removal or displacement of the information sheet by small children and natural elements such as sleet, hail, wind, rain, and any other like elements. U.S. Pat. No. 4,079,530, to Atherton et al., entitled GARDEN MARKER, issued Mar. 21, 1978, discloses a garden marker which permits easy removal and replacement of the informational sheet portion of the identification holder. Another interchangeable sign system is disclosed in U.S. Pat. No. 5,369,902, to Minster, entitled INTERCHANGEABLE SIGN SYSTEM, issued Dec. 6, 1994. The identification holders disclosed in the '530 and '902 patents, like many others known to those skilled in the identification holder art, although permitting easy removal and replacement of the information sheet of the identification holder, do not provide a sufficient deterrent to accidental or unwanted intentional removal or displacement of the information sheet of the information holder by small children and natural elements such as sleet, hail, wind, rain, and any other like elements, as stated herein above.

Identification holders which also address the long standing issue of sign deterioration are disclosed in U.S. Pat. No. 1,777,859, to A. C. Recker; U.S. Pat. No. 2,048,906, to W. R. Webster; U.S. Pat. No. 2,207,180, to B. Smith et al.; and U.S. Pat. No. 4,534,125, to Buck, for example. Although these and many others successfully address known sign deterioration issues, such solutions do so by providing identification holders having multiple components. It is therefore desirable to provide an identification holder having a unitary design for use in environments which are conducive to sign deterioration and which may require changing subject applications, while simultaneously maintaining identification indicia integrity and security.

Various identification holders having unitary design features are known in the art. These identification holders offer differing solutions to the problems presented by multiple component holders by providing identification holders which are less complex in design and less costly to manufacture. For example, U.S. Pat. No. 4,196,533, to Kamphausen, entitled PLANT MARKER, issued Apr. 8, 1980 and U.S. Pat. No. 4,304,059, to Tisbo et al., entitled MOLDED PLASTIC OPEN FACE GARDEN MARKER, issued Dec. 8, 1981, both disclose identification markers having unitary design features. Although the '533 and '059 patents disclose identification holders which are simple in design and therefore less expensive to manufacture, such designs require good dexterity to insert and remove or replace the identification sheet. Furthermore, identification holders using such designs still are amenable to tampering by children and the like. In view of the foregoing, it can be seen that information sheet holders known to those skilled in the art will not allow an information sheet to be flexed inward totally therein during its insertion into the holder housing while simultaneously preventing the information sheet from being pushed right out of the back end of the holder housing.

The present invention overcomes the aforesaid shortcoming and attendant disadvantages of identification holders know to those skilled in the art by providing a device which is durable, has a unitary design, and therefore has no moving parts.

Another feature of the present invention is the provision of an identification holder in which the information indicia such as an identification sheet can be removed with no damage to either the holder or the sheet upon removal of the identification sheet from the holder.

Yet another feature of the present invention is the provision of an identification holder in which the identification indicia can be quickly and easily inserted, replaced, or removed without requiring unusual dexterity.

Still another feature of the present invention is the provision of an identification holder in which the identification indicia cannot be easily removed or displaced by child tampering, the natural elements, and the like.

Another feature of the present invention is the provision of an identification holder in which the information sheet cannot be easily accidentally removed, but is easy to remove intentionally with use of a proper removal tool.

SUMMARY OF THE INVENTION

The disadvantages and limitations of the background art discussed herein above are overcome by the present invention which includes a molded unitary identification holder. The holder includes a housing having a desired aesthetic shape and further having an open face cavity with a substantially fully enclosed back portion. As used herein, a "substantially fully enclosed back portion" includes any solid back portion devoid of holes or orifices of any kind, but also includes any sold back portion containing one or more holes or orifices, each of which has a maximum dimension of les than one-quarter inch, which is small enough to prevent a child finger from protruding through the holes or orifice. In one preferred embodiment, the back portion has a plurality of holes, e.g. as in a common window screen, or a plurality of slots, which will prevent sleet, wind, rain, hail, and other such elements from damaging or displacing an information sheet inserted into the holder housing and which may also be used to allow some natural light to reach and illuminate the information sheet, especially is the sheet is constructed of a transparent or translucent material.

The open face cavity accommodates the outer peripheral edges of the identification sheet to position and locate the identification sheet. The outer periphery of the open face cavity has one or more undercuts of predetermined size and shape and configured for removably receiving and securing a desired outer portion of the identification sheet after the identification sheet has been positioned within the open face cavity.

An elongated stake, suitable for being driven into the earth by the user, depends downwardly from the bottom edge of the housing. The stake element includes a shank of relatively narrow width between the housing portion and the end formation, and is provided with at least one longitudinally extending rib-like formation to enhance the strength and rigidity.

In one aspect of the present invention, the construction and arrangement is employed wherein a flexible identification sheet is securely attached to the holder housing simply by centering the flexible identification sheet on the holder housing open front face cavity and pushing inward on the identification sheet thereby causing flexation of the identification sheet and forcing the identification sheet into the open front face cavity until the mounting ears or tabs on the identification sheet engage with the undercuts. In this manner, the present invention is fully assembled in less time and requires less dexterity than existing identification holders.

In yet another aspect of the present invention, the construction and arrangement is employed wherein a tool such as a pencil or the like is inserted through the optional opening in the back portion of the holder housing until the tool makes contact with the identification sheet. Thereafter, the tool is pushed against the identification sheet to flex outwardly until the mounting ears or tabs disengage from the undercuts and release the identification sheet from the housing. This process ensures that the identification sheet remains seated within the holder housing, free from being displaced by small children who may be playing near the identification holders.

Still another aspect of the present invention allows an identification sheet to be easily inserted and removed from an identification holder housing, while simultaneously preventing easy accidental removal of the identification sheet from the holder housing by sleet, hail, wind, rain, and other such elements.

An additional feature afforded by the present invention is improved durability and low cost of manufacture due to the unitary design.

Yet another feature afforded by the present invention is the elimination of moving parts commonly used by many other types of identification holders known to those skilled in the art.

Still another feature afforded by the present invention is the provision of an identification holder configured to allow easy insertion of an information sheet into the identification holder housing, while simultaneously preventing the information sheet from being pushed right out the back end of the identification holder housing.

BRIEF DESCRIPTION OF THE DRAWINGS

Other features of the present invention and many of the attendant advantages of the present invention will be readily appreciated as the same becomes better understood by reference to the detailed description when considered in connection with the accompanying drawings in which like reference numerals designate like parts throughout the figures thereof and wherein:

in FIG. 8;

DETAILED DESCRIPTION OF THE PREFERRED EMBODIMENTS

The preferred embodiments described as follows, address the long felt need by those in the identification holder art to provide an interchangeable sign system for use in environments conducive to sign deterioration, and having changing subject applications and particular viewing requirements, and that permits quick and easy insertion, intentional removal and replacement of the informational sheet of the identification holder, while substantially preventing intentional or accidental removal or displacement of the informational sheet by either small children and the like or sleet, hail, wind, rain, and other such elements.

Figure 1:
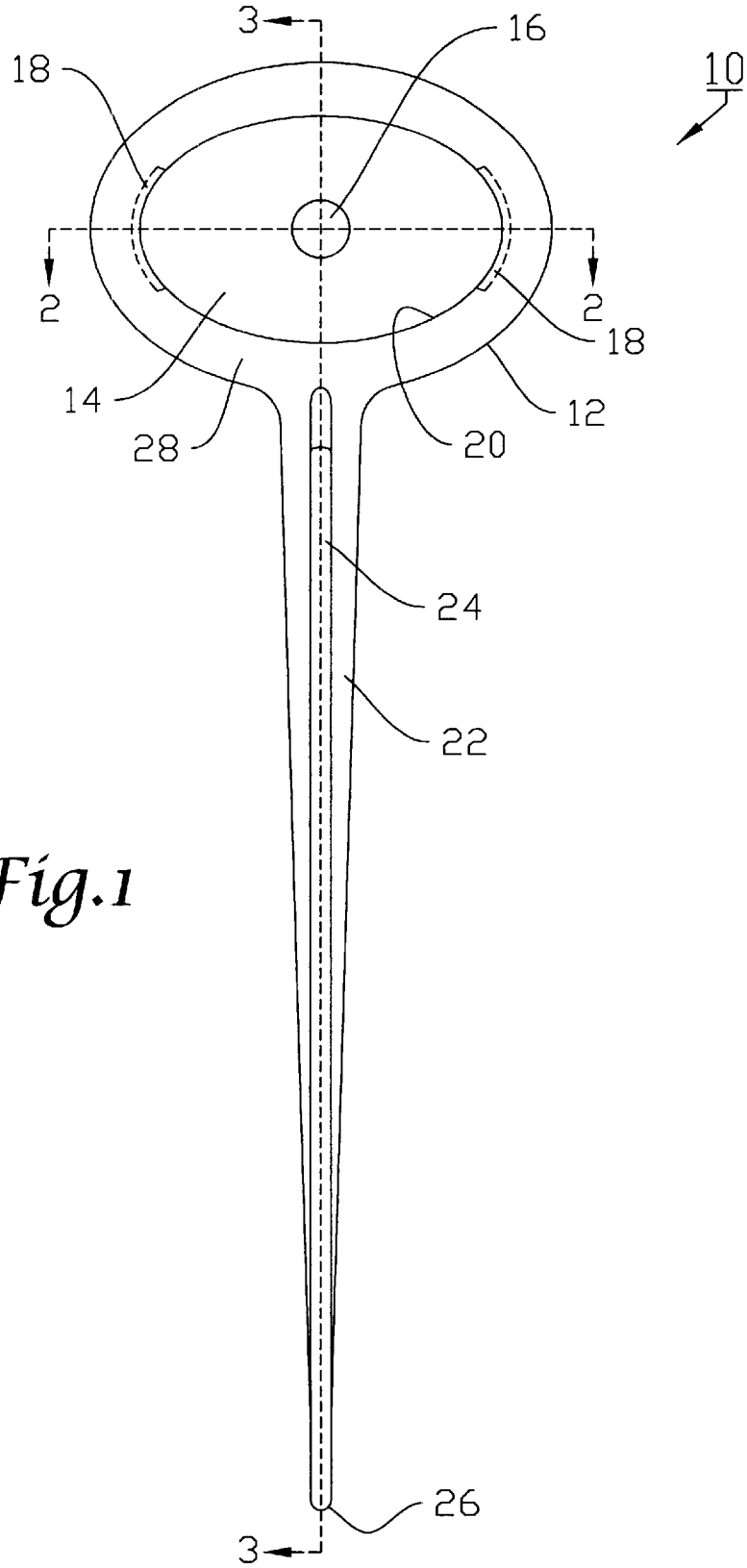
FIG. 1 illustrates a front view of one preferred embodiment for the present identification holder.

Referring now to the drawings for a detailed description of the present invention and, initially, to FIG. 1 for this purpose, one preferred embodiment of an identification holder 10 is illustrated. Most preferably, identification holder 10 is of unitary design. The present invention is not so limited however, and those skilled in the art will appreciate that the identification holder 10 could just as well be assembled from a combination of individual parts. For example, the stake element 22 and holder housing 12 could be individual and distinct elements which could be joined to form a single unitary device utilizing any known method of joining such elements such as by any satisfactory thread bearing means, snap fitting means, friction fitting means, gluing, and the like. Identification holder 10 can be formed from any number of satisfactory materials, some examples being metal, wood, various types of plastic, clay and various types of rubber.

Figure 6:
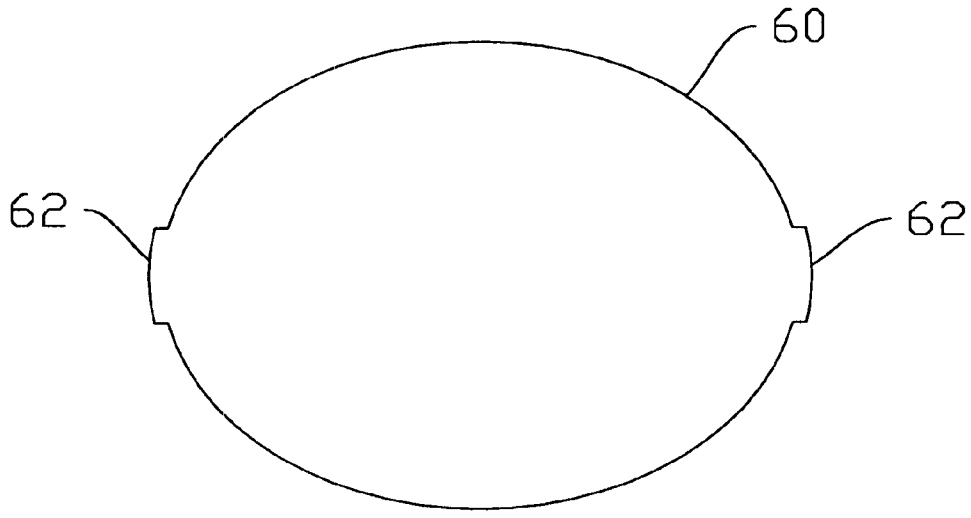
FIG. 6 illustrates a front or rear view of one embodiment of an identification sheet suitable for use with the identification holder depicted in FIG. 1.
Figure 7:
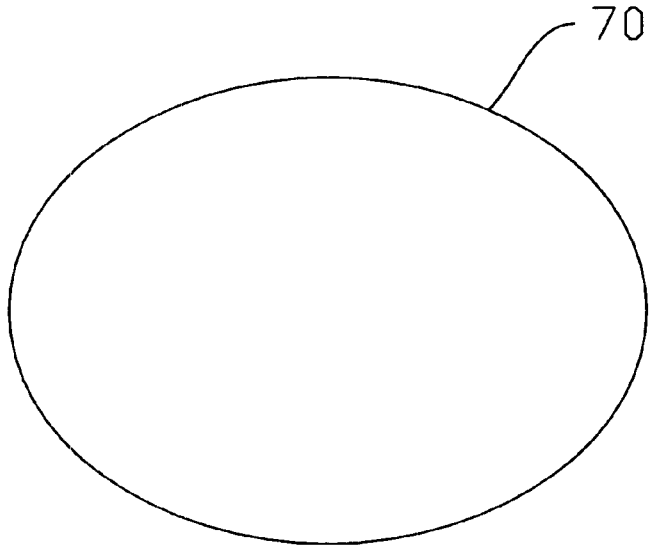
FIG. 7 illustrates a front or rear view of yet another embodiment of an identification sheet suitable for use with the identification holder depicted in FIG. 1.

Looking again at FIG. 1, identification holder 10 includes a hollow housing section 12 for accommodating an information sheet such as shown as reference numeral 60 in FIG. 6 and reference numeral 70 in FIG. 7. Although hollow housing section 12 is shown having an oval shape, other shapes can also be used without departing from the scope of the present invention. For example, a square or rectangular shape could also be used when it is desired to adapt the identification holder 10 for use as a name tag, name plate, or sign and the like. Housing section 12 has a cavity or interior display chamber 14 which is open when viewed from the front face 28 and closed when viewed from the back outer side of the back section 30 (illustrated in FIG. 2), of housing section 12. Most preferably, cavity or interior display chamber 14 has a shape substantially similar to the shape of housing section 12 for aesthetic purposes, although other cavity shapes will also suffice. Particularly noteworthy is the optional tool insertion through-hole or orifice 16 which is most preferably centered on the back section 30. Tool insertion through-hole or orifice 16 is preferably sized to allow a small-radiused, thin or flat rod-like insertion tool such as a pencil (not illustrated) through which to be inserted, but small enough to prevent a child's finger from protruding through the insertion through-hole 16 and intentionally or accidentally disengaging or displacing the informational sheet 60 secured within the hollow housing section 12. The tool insertion through-hole 16 is preferably small enough to also prevent elements such as sleet, hail, wind, rain, and other such elements from easily accidentally displacing the informational sheet 60. The present inventors found a hole having maximum width or diameter of about one-quarter inch to provide workable results. It will be appreciated that the present invention is not so limited however, and that larger through-hole or orifice 16 widths and/or diameters will also work to provide the necessary function of allowing insertion tool removal of an informational sheet 60, 70 attached to the hollow holder housing 12. It shall be understood that the present inventive identification holder can also be configured to function with through-holes 16 having shapes other than circular or round. For example, the through-holes 16 can be formulated using squares, slots, triangles, and the like, or any other shape so long as the dimensions and configuration of each through-hole 16 functions to prevent penetration of a child's finger there through while simultaneously protecting the information sheet 60 from displacement by sleet, hail, wind, rain, and other like elements. As stated herein before, the identification holder 10 can also be configured to function without use of any through-holes 16. A detailed description of an alternative embodiment for the present inventive identification holder that is configured without any through-holes 16 is described herein below with reference to FIGS. 8–12.

Figure 5:
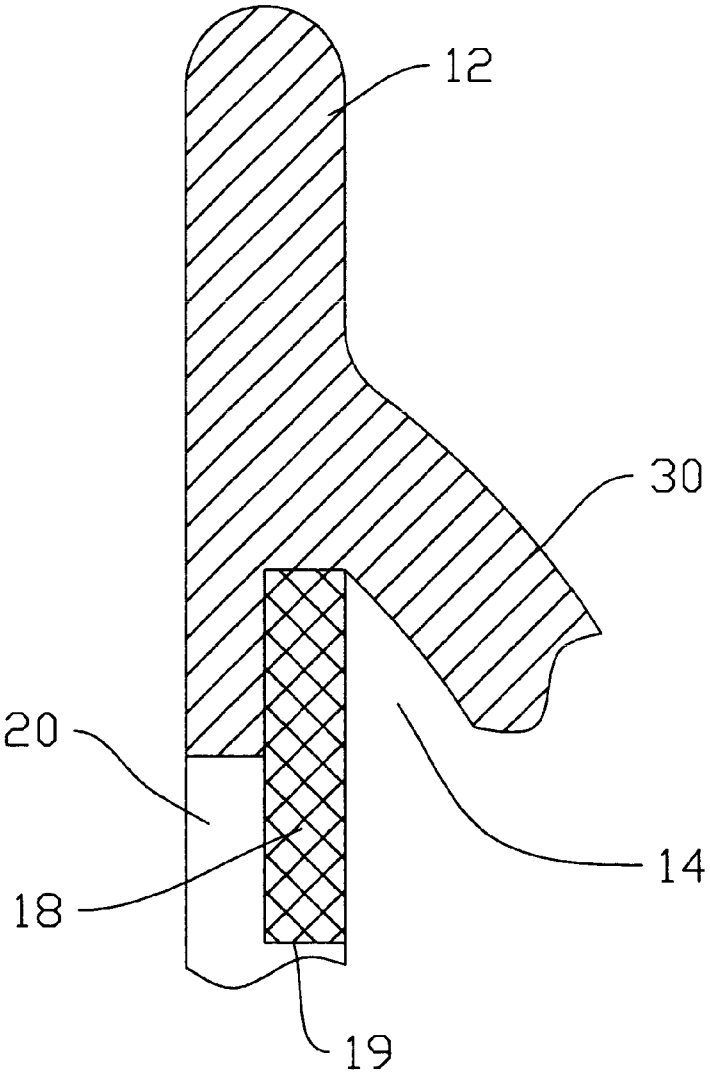
FIG. 5 illustrates a magnified detail view of a portion of the device shown in FIG. 1 showing preferred undercut features.

Also particularly noteworthy are the undercuts 18, illustrated in greater detail in FIG. 5. Undercuts 18 are formed generally by molding or cutting at least one notch within the interior display chamber 14 shaped to securely accept insertion of information sheet tabs 62 shown in FIG. 6. Most preferably, two or more undercuts 18 are used to secure the information sheet 60, 70 within the housing section 12, although at least a single undercut 18 is necessary to practice the present invention. Undercuts 18 extend between termini 19. Undercuts 18 are most preferably formed at the inner periphery 20 of the hollow housing section 12 front face 28 just at the point where the back section 30 joins the housing section 12 as more clearly illustrated in FIG. 5. Note that in FIG. 5, the undercuts 18 are illustrated with cross-hatching to show which portions are recessed with respect to the rest of the inner periphery 20. The single line pattern indicates cutaway portions of housing 12. Alternatively, a continuous single undercut 18 could be formed around the entire inner periphery 20 of the housing section 12 front face 28. In yet another embodiment, one or more undercuts 18 could also be formed a desired distance away from the inner periphery 20 of the housing section 12 front face 28. In this instance, the undercuts 18 could be embodied within the back section 30 such that pressing an informational sheet 60, 70 against the inner surface of the back section 30 forces the information sheet tabs 62 to be securely engaged within the undercuts 18, but not necessarily proximal the inside surface of the housing front face 28. In view of the foregoing description, it can be seen that the undercuts 18 form at least one portion shaped for removably receiving at least one edge of a flexible information sheet such that an information sheet can be retained wit the interior display chamber 14. Further, it can be seen with reference also to FIG. 2, that the interior display chamber 14 has a maximum depth measured between the front face 28 and the rearward most portion of the arcuate back section 30 of the housing section 12 that is greater than either the depth or the width of the one or more undercuts 18.

Identification holder 10 also includes an elongated stake element 22, suitable for being driven into the earth by the user. Stake element 22 preferably depends downwardly from the center of the bottom edge of the housing section 12, and includes a shank of relatively narrowing width between the housing section 12 and the end formation 26. It can be seen that stake element 22 is provided with at least one longitudinally extending rib-like formation 24 to enhance the strength and rigidity. The present invention is not so limited however, and it will readily be recognized that a plurality of stake elements 22 could be utilized, or that stake element 22 need not necessarily depend from the center of the bottom edge of the housing section 12, but could also be offset.

Figure 2:
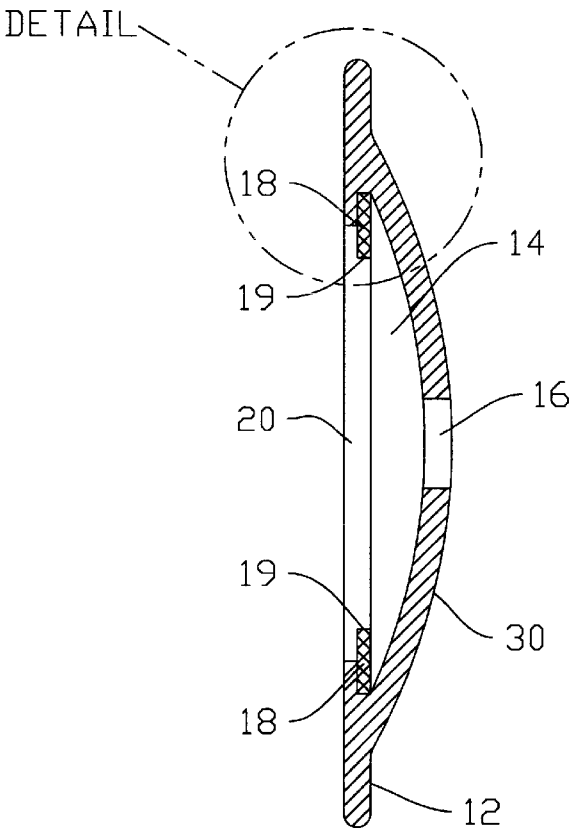
FIG. 2 illustrates a top section elevational view of a portion of the device shown in FIG. 1, the section being taken along line 2—2 in FIG. 1.

Looking now at FIG. 2, there is illustrated a top cross sectional view of the identification holder housing 12 taken along lines 2—2 in FIG. 1. Two undercuts 18 are illustrated terminating at termini 19. The undercuts 18 are illustrated as cross-hatched portions to show That the undercuts 18 are recessed with respect to the rest of the periphery 20. The single line pattern indicates cutaway portions of housing 12. As Stated herein before, a single continuous undercut 18 could be employed as well as any desired plurality of undercuts 18 structurally compatible with the selected holder housing 12 design. The optional tool insertion through-hole 16 is preferably centered on the back section 30 of the holder housing 12, but could also be offset from the centered position. The present invention is not limited to the use of a single tool insertion through-hole 16 however, and a plurality of tool insertion through-holes 16 could also be employed to accomplish removal of information sheets, 60, 70 attached to holder housing 12. Although an arcuate shaped back section 30 is shown in the preferred embodiment, other aesthetically desirable shapes can also effectively be utilized to form the hollow holder housing 12 so long as a cavity or interior display chamber 14 having adequate space is provided to allow inward flexation of the informational sheet 60, 70 totally during sheet 60, 70 insertion into the hollow holder housing 12, thereby enabling the sheet 70 or tabs 62 to be securely received by the one or more undercuts 18.

Figure 3:
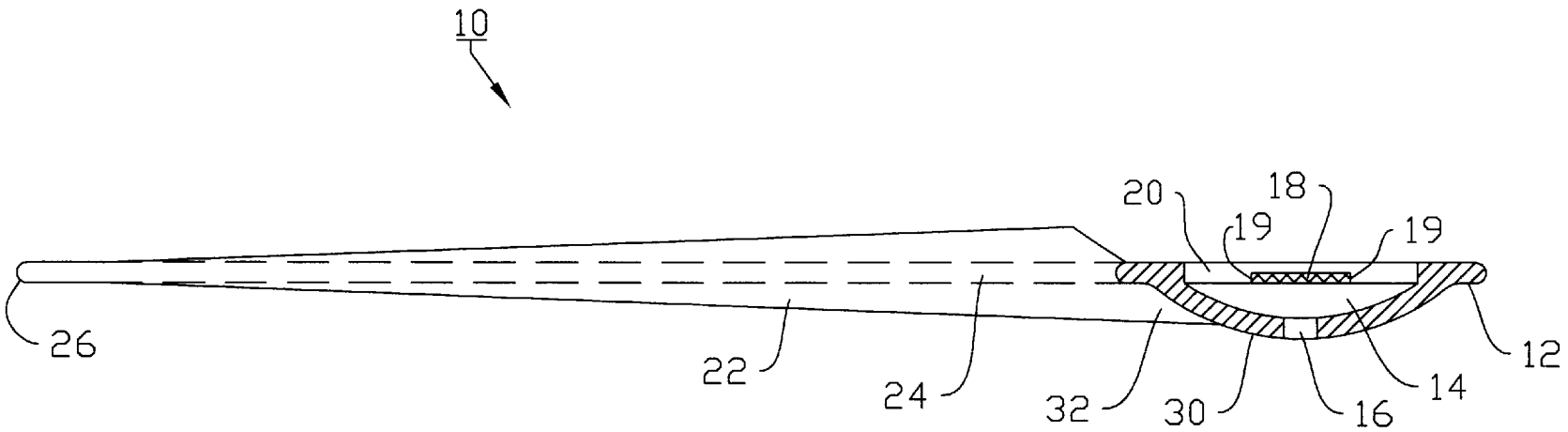
FIG. 3 illustrates a side sectional elevational view of a portion of the device shown in FIG. 1, the section being taken along line 3—3 in FIG. 1.

FIG. 3 illustrates a side sectional view of a portion of the identification holder 10 shown in FIG. 1, the section taken along lines 3—3 in FIG. 1. As stated herein above, elongated stake 22 is provided with at least one longitudinally extending rib-like formation 24 to enhance the strength and rigidity. The stake element 22 is preferably molded as a single unitary component along with the housing holder 12. Although the top portion of stake element 22 is depicted in the preferred embodiment as having a rear rib portion which extends downwardly from the back section 30 of the housing holder 12, other rib-like formation structures 24 could also be utilized so long as the strength and rigidity of the unitary identification holder 10 is maintained. Undercut 18 preferably extends between termini 19. Again, undercut 18 is illustrated with cross-hatching lines to indicate that the undercut 18 is recessed with respect to the rest of the inner periphery 20. The single line pattern indicates cutaway portions of housing 12.

Figure 4:
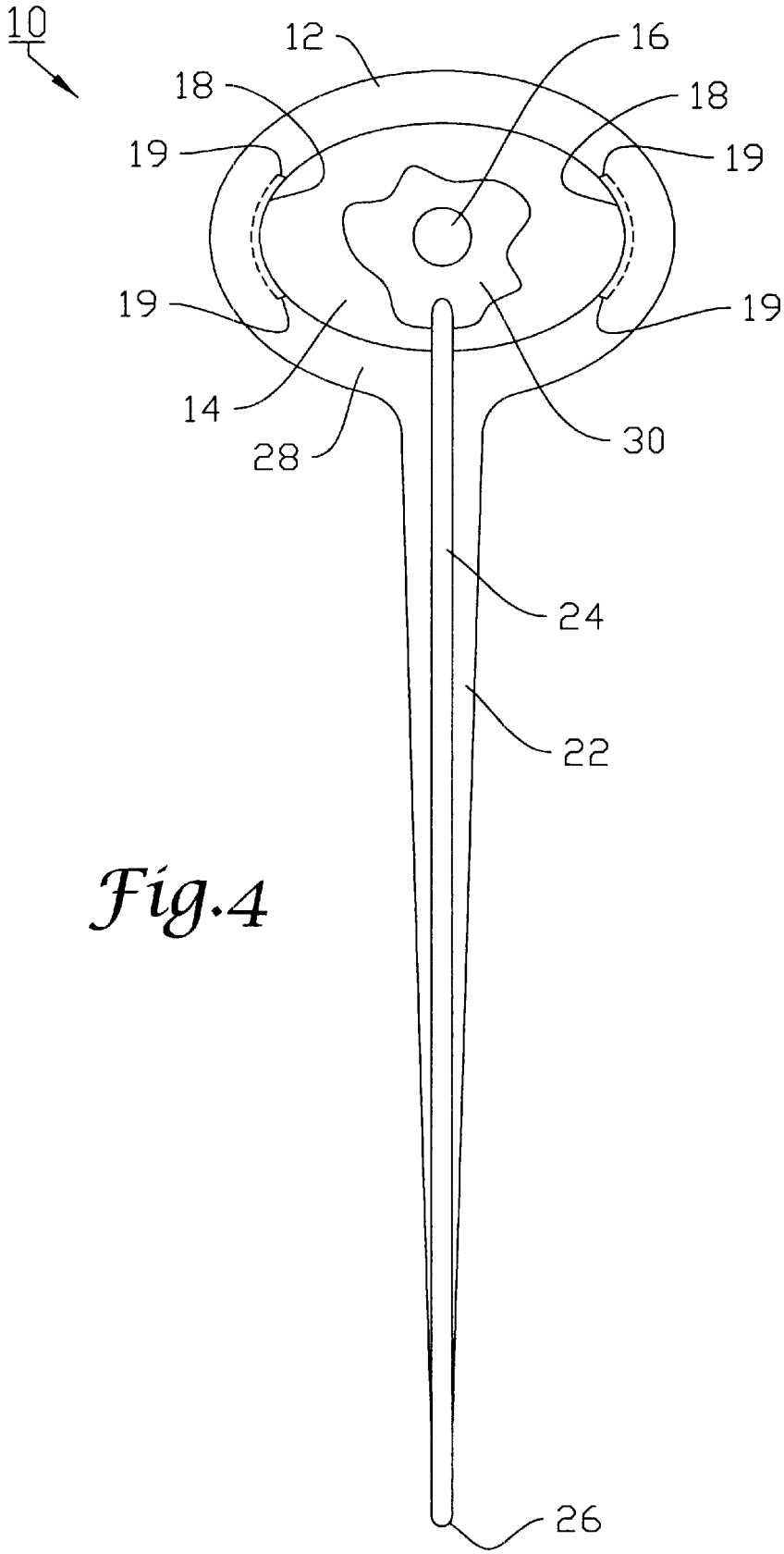
FIG. 4 illustrates a back view, having a peripheral portion of back section 30 removed.

FIG. 4 illustrates a back view of the identification holder 10 where a peripheral portion of back section 30 has been removed depicting in greater detail various aspects for the embodiment of the device shown in FIG. 1. Insertion tool through-hole 16 protrudes completely through the back section 30 and is preferably sized to allow a desired tool such as a standard size lead school pencil or other similarly sized rod-like tool, to pass through the opening formed by the through-hole 16 but to prevent a child's finger from passing through the same opening and dislodging the informational sheet 60 which is attached to the identification holder 12. It will be appreciated that the present invention is not limited to having an insertion through-hole 16 which is circular in shape. For example, the insertion through-hole 16 could just as well have the shape of a slot, square, triangle, slit, or any other shape, so long as the intended functions described herein are retained. As stated herein above, through-hole 16 is preferably sufficiently small such that elements such as sleet, hail, wind, rain, and other such elements will not easily accidentally dislodge the informational sheet 60. It will be appreciated by those skilled in the identification holder art that the use of one or more such holes will also allow substantial natural back lighting which will enhance user readability when the informational sheets 60, 70 are made of translucent or transparent materials. The unitary holder 10 design eliminates moving parts, enhances durability, reduces cost, increases reliability and improves manufacturability, as stated herein before. Undercuts 18 extend between termini 19.

Housing 12, therefore, includes a flange or front face 28 defining an opening. The opening is proximate an interior display chamber 14 defined by a side wall and a back wall, the side wall having a plurality of notches or undercuts 18 facing chamber 14, and the back wall having a first surface facing chamber 14 having a concave shape.

Moving now to FIG. 5, a magnified detail view of a portion of the identification holder 10 shown in FIG. 1 depicting one preferred structure for the undercuts 18 is illustrated. A single partial undercut 18, a plurality of undercuts 18, or a single continuous undercut 18 traversing the entire periphery of the cavity 14 may selectively be employed to receive informational sheets 60, 70 or tabs 62. Most preferably, any undercut 18 is formed by creating a notch having radiused surfaces as opposed to a series of flat surfaces joined at the corners, although the use of such flat surfaces will also function for the intended purpose of securely receiving informational sheet tabs 62. The use of such radiused surfaces will allow for optimum ease of installation and removal or replacement when attaching to or detaching from the identification holder 10, informational sheets 60, 70, thereby reducing the user dexterity required to assemble the device. The present invention is not so limited however, and it will be readily understood that although the means for engaging informational sheets 60, 70 such as those illustrated in FIGS. 6 and 7 have been described herein above as undercuts 18, any suitable means suitable for engaging and removably receiving selected peripheral portions of the informational sheets 60, 70 may be employed so long as the engagement means allows for easy intentional sheet 60, 70 insertion, removal and replacement while simultaneously preventing easy accidental dislodgment or displacement of the informational sheets 60, 70.

FIG. 6 illustrates a front view of one preferred embodiment for an informational sheet 60 suitable for use with the identification holder shown in FIG. 1. The informational sheet 60 has tabs 62 which are shaped to mate with and be received by undercuts 18 disposed within the hollow holder housing 12 interior display chamber 14. The identification holder 10 and associated informational sheet 60 can be used to identify or provide information about an associated plant when used as a plant marker. The holder 10 and sheet 60 can easily be adapted for other uses simply by changing the informational indicia embodied upon the informational sheet 60 and/or changing the structural characteristics of the holder 10. For example, the holder 10 and sheet 60 could also be used as an identification badge, name tag, desk name plate, label, or sign, and the like simply by removing the stake element 24 and altering the shape of the holder housing 12 to aesthetically suit the desired application. Preferably, information sheet 60 is manufactured of a rigid, flexible material which returns to its original shape subsequent to flexing. Information sheet 60 is preferably manufactured to include colorful information indicia that will not fade or run due to weathering and use by incorporating silk screening methods known to those skilled in the art and incorporating ultraviolet-inhibited indicia, also know to those skilled in the art.

The informational sheet 60 can be manufactured to include one or more tabs 62 as stated herein before. Alternatively, informational sheet 60 can also be manufactured such that its outer periphery functions as a tab. Such an embodiment is illustrated as numeral 70 in FIG. 7. The informational sheet 70 shown in FIG. 7 is sized to mate with a holder housing 12 having a single continuous notch around the entire periphery of the front face cavity 14 and proximal the inner periphery of the front face 28. This configuration offers greater sheet retention characteristics than configurations utilizing the informational sheet 60 embodied in FIG. 6 once inserted into a holder housing 12 and secured into the desired location by the required undercut 62 necessary to accept the informational sheet 70.

FIGS. 8–11 illustrate and identification holder 100 in accordance with yet another preferred embodiment for the present invention. As stated herein before, the identification holder 100 is similar to the embodiment described above with respect to FIGS. 1–5. However, identification holder 100 can be seen to include a substantially fully enclosed back portion 14 that is devoid of holes or orifices there through. Like the embodiment depicted in FIGS. 1–5, identification holder 100 is configured with dimensions that allow an information sheet to be flexed fully inward upon insertion into the housing 12. Once inserted, an information sheet can be removed with a sheet removal tool that is configured to make contact with a selected edge portion or back portion of the information sheet. Note that, as in FIGS. 2 and 3, FIGS. 9 and 10 include cross-hatching in undercuts 18 to indicate that the undercut 18 is recessed with respect to the rest of the inner periphery 20. The single line pattern indicates cutaway portions of housing 12.

Figure 8:
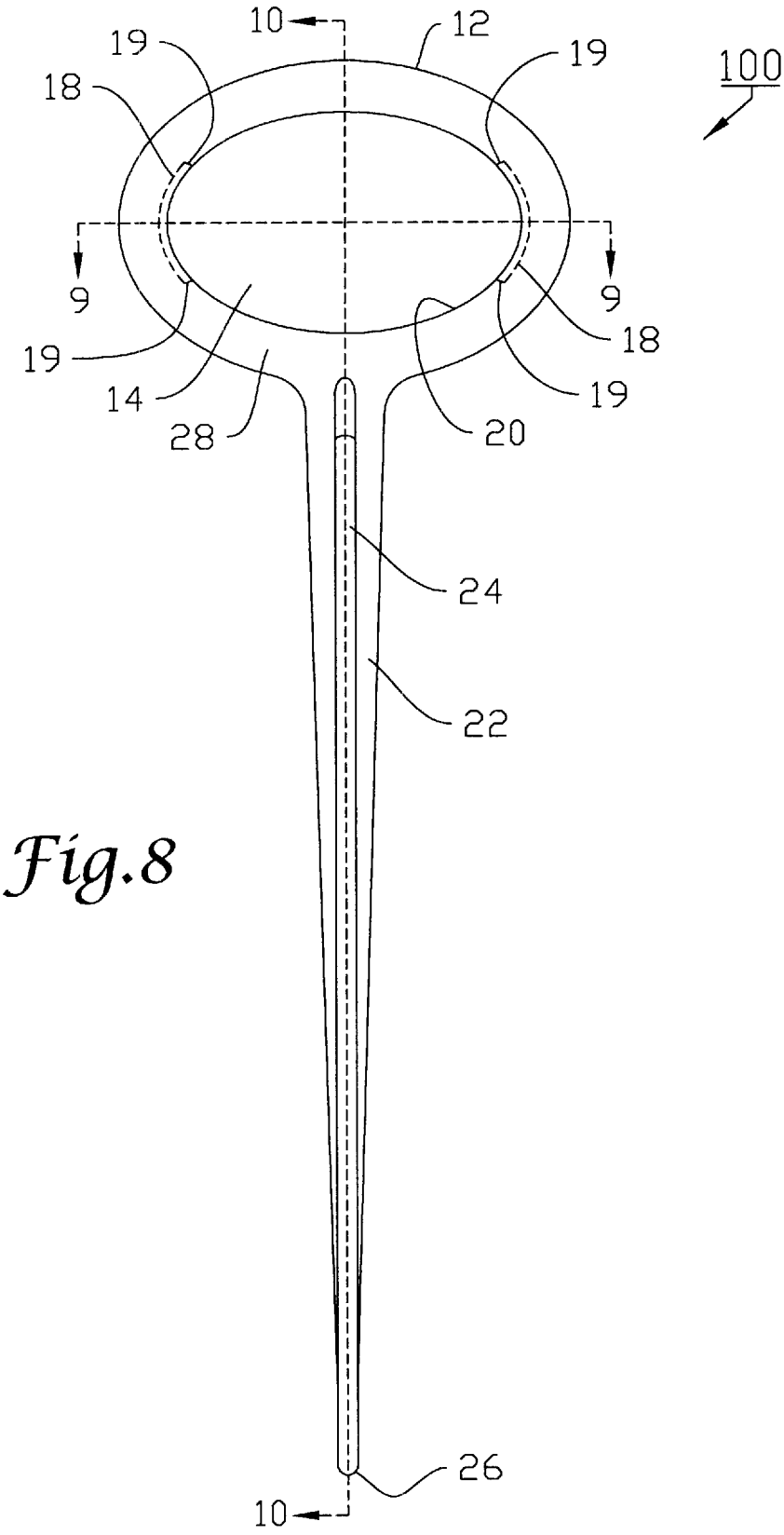
FIG. 8 illustrates a front view of another preferred embodiment for the present identification holder.
Figure 9:
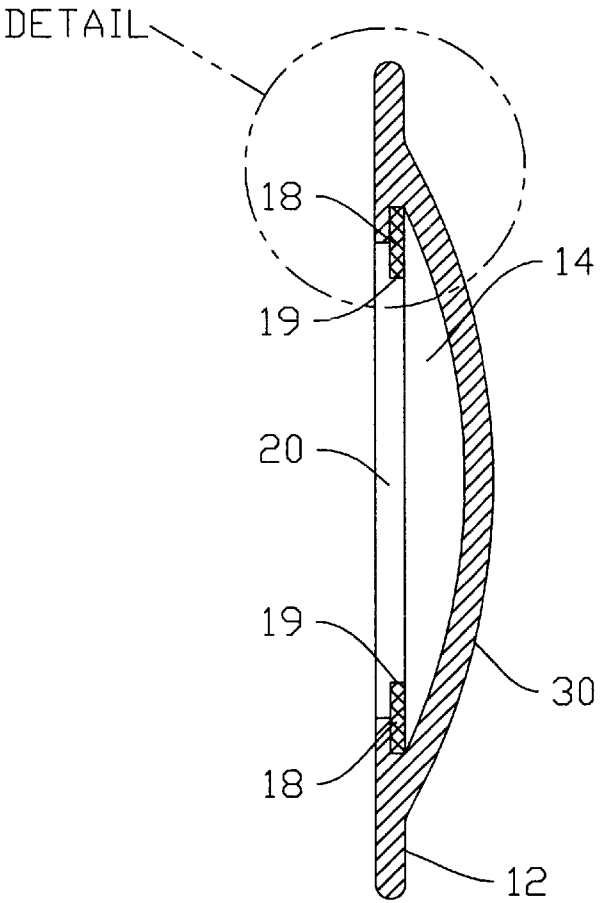
FIG. 9 illustrates a top section elevational view of a portion of the device shown in FIG. 8, the section being taken along line 9—9 in FIG. 8.
Figure 10:
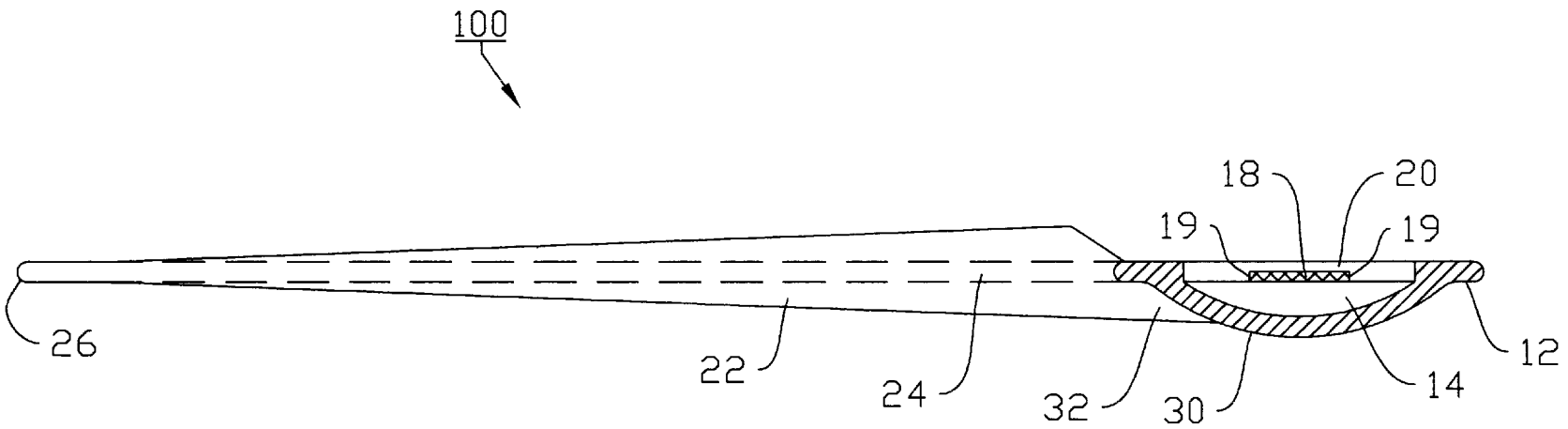
FIG. 10 illustrates a side sectional elevational view of a portion of the device shown in FIG. 8, the section being taken along line 10—10.
Figure 11:
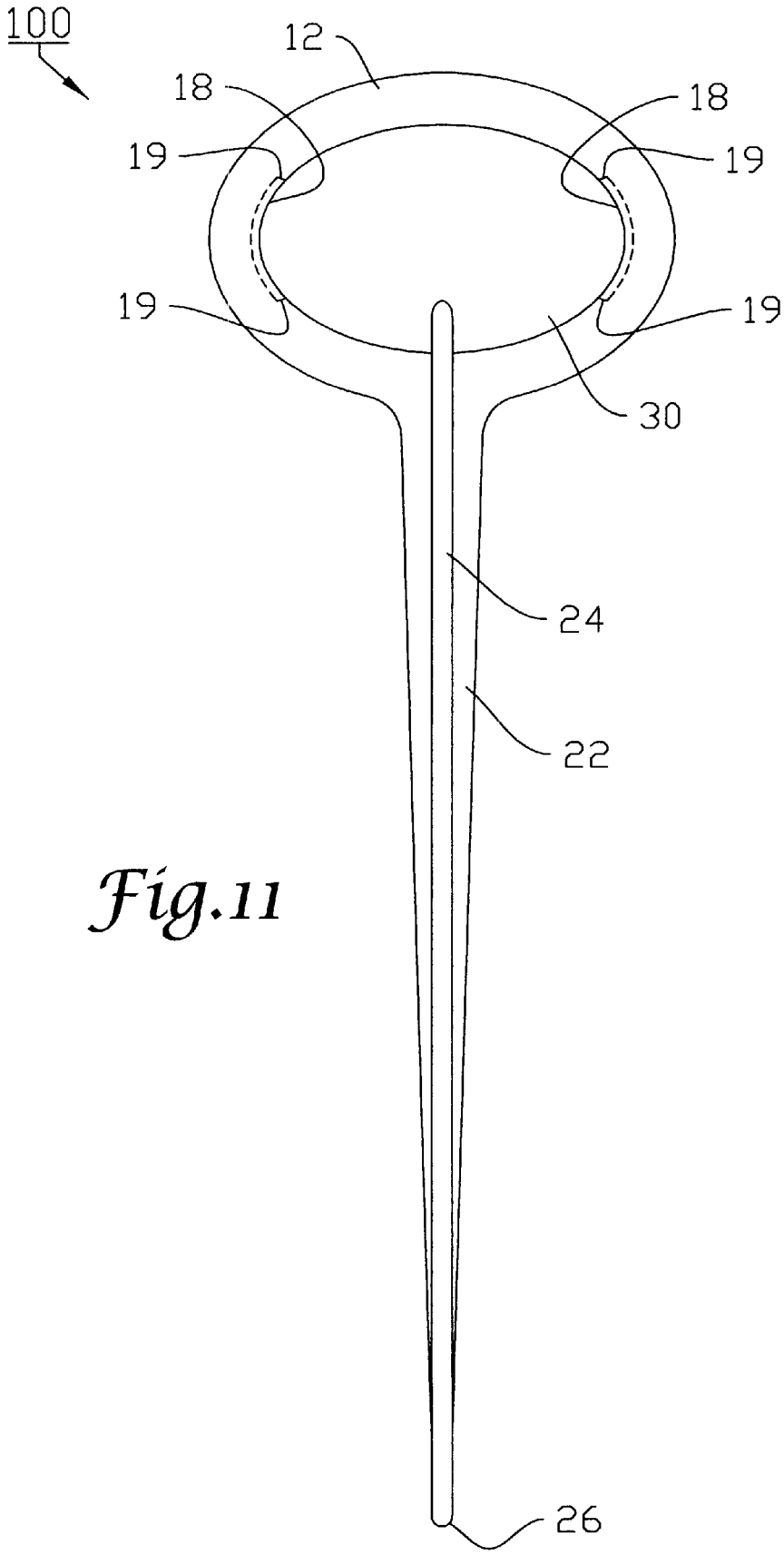
FIG. 11 illustrates a back view of the embodiment of FIG. 8 with the back wall removed.
Figure 12:
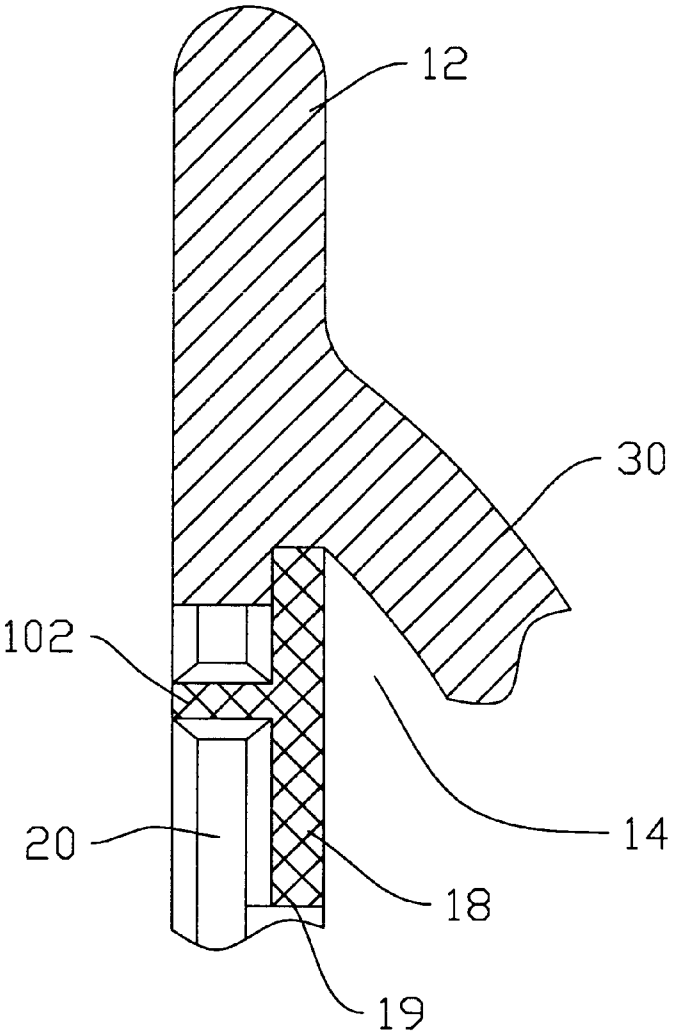
FIG. 12 illustrates a magnified detail view of a portion of the device shown in FIG. 8 showing preferred undercut features.

With reference now to FIG. 12, a magnified detail view illustrates a portion of the identification holder 100 shown in FIG. 8 depicting undercut 18 features having at least one sheet removal tool insertion slot 102 configured therein to accommodate information sheet removal. Note that, again, the undercut 18 and the insertion slot 102 have been cross-hatched to indicate that both are recessed with respect to the rest of the inner periphery 20. The single line pattern indicates cutaway portions of housing 12. It can be readily appreciated that once installed, an information sheet cannot be easily removed or displaced without accessing a selected edge or back portion of the information sheet via a sheet removal tool to cause the information sheet to be unseated and extracted from the undercut 18, e.g. prying with a knife blade or screw driver. Each undercut 18 preferably has one or more sheet removal tool insertion slots 102 selectively positioned to accommodate the aforesaid information sheet extraction process. The present invention is not limited to the particular embodiment shown however, and it shall be understood that an information sheet, or the, identification holder 100, or an information sheet and the holder 100 in combination can be configured with one or more such slots to allow insertion tool access to selected edge or back portions of an information sheet. In view of the foregoing description it can be seen that the undercuts 18 form at least one portion shaped for removably receiving at least one edge of a flexible information sheet such that an information sheet can be retained within the interior display chamber 14. Further, it can be seen with reference also to FIGS. 2, 3, 9 and 10, that the interior display chamber 14 has a maximum depth measured between the front face 28 and the rearward most portion of the back section 30 of the housing section 12 that is greater than either the depth of the width of the one or more undercuts 18.

This invention has been described herein in considerable detail in order to comply with the patent statutes and to provide those skilled in the art with the information needed to apply the novel principles and to construct and use such specialized components as are required. In view of the foregoing descriptions, it should be apparent that the present invention represents a significant departure from the prior art in construction and operation. Further it provides for improving the quality of manufacturing yield by eliminating or significantly reducing multiple component parts. However, while a particular embodiment of the present invention has been described herein in detail, it is to be understood that various alterations, modifications and substitutions can be mad therein without departing from the spirit and scope of the present invention, as defined in the claims which follow. For example, it will be apparent to those skilled in the arts of molding and manufacturing engineering that although particular 18 shapes and locations have been illustrated, that many other undercut shapes and locations will also work to provide the intended functions of securely receiving and associated information card or sheet 60, 70. It shall also be understood that although one embodiment of the present invention has been described herein above as having a back portion including at least one through-hole 16 penetrating there through, the present inventive identification holder can be configured without any such through-holes 16, so long as the interior display chamber retains dimensions that functionally permit the flexible information sheet to be flexed inward totally therein during its insertion and engagement within the novel identification holder 100. It shall be further understood that the present inventive identification holder can be configured with a screen-like back portion having a mesh sufficient to prevent penetration by a child's finger, wile simultaneously retaining its weather protective shroud and its containment characteristic to prevent an information sheet from being pushed out through the back portion during insertion of the information sheet.

We claim:

1. An identification marker, comprising:

a housing comprising a flange defining an opening, a side wall, a back wall, the back wall and the side wall defining a cavity, the side wall having a plurality of notches facing toward the cavity, the back wall having one or more apertures, each aperture defining a void area and a perimeter such that any point in the void area has a dimension extending to the perimeter of no greater than one quarter inch, the back wall having a first surface proximate the notches in the side wall and having a concave shape;

a flexible identification sheet comprising a face portion having a perimeter of generally the same shape as the opening defined by the flange and tabs extending therefrom such that the tabs extend from the perimeter only in such places as correspond to the notches in the side wall of the housing; and an elongate stake extending from the housing;

wherein the opening, the side wall and the notches are sized such that the flexible identification plate may be retained by the housing in a flat and uncompressed position.

2. The identification marker of claim 1, wherein the opening in the housing has an elliptical shape.

3. The identification marker of claim 1, wherein at least one of the apertures is circular.

4. The identification marker of claim 1, wherein the plurality of tabs are equally spaced around the perimeter of the flexible identification sheet.

5. The identification marker of claim 1, wherein the stake further comprises one or more longitudinal ribs.

6. The identification marker of claim 1, wherein the plurality of tabs comprise one or more pairs of tabs, each pair of tabs having a first tab and a second tab, wherein the first tab is disposed opposite the second tab on the perimeter of the flexible identification sheet.

7. An identification marker, comprising:

a housing comprising a flange defining an opening, a side wall, a back wall, the back wall and the side wall defining a cavity, the side wall having a plurality of notches facing toward the cavity, the back wall having one or more apertures, each aperture defining a void area and a perimeter such that any point in the void area has a dimension extending to the perimeter of no greater than one quarter inch, the back wall having a first surface proximate the notches in the side wall and having a concave shape; and a flexible identification sheet comprising a face portion having a perimeter of generally the same shape as the opening defined by the flange and tabs extending therefrom such that the tabs extend from the perimeter only in such places as correspond to the notches in the side wall of the housing;

wherein the opening, the side wall and the notches are sized such that the flexible identification plate may be retained by the housing in a flat and uncompressed position.

* * * * *